US008621977B2

(12) United States Patent
Sieber et al.

(10) Patent No.: US 8,621,977 B2
(45) Date of Patent: Jan. 7, 2014

(54) RECIPROCATING PISTON ENGINE

(75) Inventors: Frank Sieber, Aalen (DE); Tilo Schäfer, Daubach (DE); Jan Hinrichs, Friedrichsdorf (DE)

(73) Assignee: IXETIC MAC GmbH, Bad Homburg (DE)

( * ) Notice: Subject to any disclaimer, the term of this patent is extended or adjusted under 35 U.S.C. 154(b) by 880 days.

(21) Appl. No.: 12/668,000

(22) PCT Filed: May 20, 2008

(86) PCT No.: PCT/EP2008/004011
§ 371 (c)(1),
(2), (4) Date: May 12, 2010

(87) PCT Pub. No.: WO2009/010118
PCT Pub. Date: Jan. 22, 2009

(65) Prior Publication Data

US 2010/0258003 A1 Oct. 14, 2010

(30) Foreign Application Priority Data

Jul. 13, 2007 (DE) ..... 10 2007 032 652
Sep. 4, 2007 (DE) ..... 10 2007 041 934

(51) Int. Cl.
*F01B 3/00* (2006.01)

(52) U.S. Cl.
USPC ..... 92/12.2; 92/71

(58) Field of Classification Search
USPC ..... 92/12.2, 71; 91/499, 504, 505; 417/269
See application file for complete search history.

(56) References Cited

U.S. PATENT DOCUMENTS

| | | | | |
|---|---|---|---|---|
| 5,953,979 | A | 9/1999 | Eitai et al. | |
| 5,980,216 | A * | 11/1999 | Tokumasu | 92/12.2 |
| 6,164,252 | A | 12/2000 | Kuhn et al. | |
| 6,705,841 | B2 | 3/2004 | Pawelski et al. | |
| 2004/0120830 | A1 | 6/2004 | Casar et al. | |
| 2009/0110568 | A1 | 4/2009 | Schwarzkopf et al. | |
| 2009/0129947 | A1 | 5/2009 | Schwarzkopf et al. | |

FOREIGN PATENT DOCUMENTS

| | | | |
|---|---|---|---|
| DE | 19804084 | A1 | 8/1998 |
| DE | 19749727 | A1 | 6/1999 |
| DE | 10124033 | A1 | 11/2002 |
| DE | 102005018102 | A1 | 11/2005 |

(Continued)

OTHER PUBLICATIONS

Japanese First Office Action for Patent Application No. 2010-516378 with English Translation, mailed Nov. 20, 2012.

(Continued)

*Primary Examiner* — Michael Leslie
(74) *Attorney, Agent, or Firm* — Harness, Dickey & Pierce, P.L.C.

(57) ABSTRACT

A reciprocating piston engine, particularly a coolant compressor for motor vehicles, includes at least one piston movably supported in a cylinder. A pivot element in the form of a pivot ring is supported on a guide body attached to a shaft in an axially movable fashion such that the pivot element can execute a pivot motion. The pivot motion causes movement of the at least one piston. Spring forces of at least one return spring act on the pivot element in the direction of a start position in which the pivot element is pivoted at a starting pivot angle to a plane on which the rotary axis of the shaft stands upright. At least one further spring element acts on the return spring with an initial tension when the pivot element is in the start position.

12 Claims, 3 Drawing Sheets

(56) References Cited

FOREIGN PATENT DOCUMENTS

| | | | |
|---|---|---|---|
| DE | 102005004840 | A1 | 8/2006 |
| EP | 0812987 | A2 | 12/1997 |
| JP | 2003-83241 | A | 3/2003 |
| JP | 2005-163673 | A | 6/2005 |
| JP | 2006-161591 | A | 6/2006 |
| WO | 2009/027000 | A9 | 3/2009 |

OTHER PUBLICATIONS

International Preliminary Report on Patentability (Chapter I of the Patent Cooperation Treaty for PCT/EP2008/004011; mailed by the International Bureau of WIPO on Feb. 18, 2010), Written Opinion of the International Searching Authority.

* cited by examiner

RECIPROCATING PISTON ENGINE

CROSS-REFERENCE TO RELATED APPLICATIONS

This application is a 371 U.S. National Stage of International Application No. PCT/EP2008/004011, filed May 20, 2008. This application claims priority to German Patent Application No. DE 10 2007 032 652.3, filed Jul. 13, 2007, and Application No. DE 10 2007 041 934.3, filed Sep. 4, 2007, the disclosures of which applications are incorporated herein by reference.

FIELD

The invention relates to a reciprocating piston engine according to the preamble of claim 1.

BACKGROUND

Reciprocating piston engines of the type mentioned here are known. They serve in particular as refrigerant compressors for regulating the passenger compartment temperature in motor vehicles. Reciprocating piston engines of this type have at least one piston supported in a moveable manner in a cylinder bore, which piston is set in motion via a pivot element that is swivel-mounted on the drive shaft of the reciprocating piston engine, which element is arranged in a drive chamber. The pivot element is connected to a guide body guided axially on the drive shaft of the reciprocating piston engine as well as also via a driving pin to the drive shaft. With a known reciprocating piston engine it is furthermore provided that spring forces of at least one return spring act on the pivot element. The spring forces thereby act in the direction of a starting position of the pivot element in which it is pivoted at a starting pivot angle to a plane on which the rotation axis of the drive shaft stands upright. The pivot element of the refrigerant compressor, which is preferably embodied without a coupling and thus permanently runs with the drive shaft of a motor vehicle, must have a speed-dependent minimum starting pivot angle so that the pivot element can pivot out at any time when the refrigerant compressor needs to provide a specific cooling capacity. In order to achieve a broad spread of the controlling range of the compressor depending on the drive chamber pressure change, the return spring must have the highest possible spring rigidity. However, it has been shown with the known reciprocating piston engines that a high spring rigidity of the return spring is an impediment to the easy pivoting of the pivot element.

SUMMARY

The object of the invention is therefore to create a reciprocating piston engine that does not exhibit the above-referenced disadvantage.

To attain this object, a reciprocating piston engine is proposed which has the features referenced in claim 1. It is characterized in that at least one further spring element is provided, which acts on the return spring with a preload when the pivot element is in its starting position. This advantageous embodiment makes it possible for the pivot element, preferably embodied as a pivot ring, to pivot out easily and unimpeded when the reciprocating piston engine, such as, for example, a refrigerant compressor, which is referred to below as the RC, for a motor vehicle, is switched on. Vibrations during the start-up of the pivot element or start-up delays are thus virtually ruled out.

A reciprocating piston engine is particularly preferred which is characterized in that the at least one further spring element is a curved disk. The further spring element thereby preferably has a lower spring rigidity than the return spring so that the pivot element starts particularly easily and a spring force characteristic curve results that merges from a flat characteristic curve into a steeper linear spring characteristic curve. A progressive spring force path is thereby created, wherein the pivot element must overcome a low spring force at the start of the reciprocating piston engine.

Furthermore a reciprocating piston engine is preferred that is characterized in that the return spring and the at least one further spring element are arranged between the guide body and the shaft of the reciprocating piston engine. This produces a particularly compact embodiment of the reciprocating piston engine.

A reciprocating piston engine is also preferred in which the return spring is embodied as a coil spring.

Furthermore a reciprocating piston engine is preferred that is characterized in that at least one stop element is provided, which sets the starting pivot angle of the pivot element. The stop element is preferably a spring assembly or at least one belleville spring, but other spring elements can also be provided.

With a further preferred reciprocating piston engine, the return spring has a lower spring rigidity than the stop element. This ensures in particular that the return spring does not pivot the pivot element against the force of the stop element into a pivot angle position that has a smaller pivot angle than the starting pivot angle.

Finally, a reciprocating piston engine is preferred that is characterized in that the at least one further spring element is arranged in series to the return spring. Preferably, it is also provided that, with an increasing pivot angle, the at least one further spring element together with the return spring produces a progressive spring characteristic curve with low starting spring force which reflects the advantageous starting properties of the reciprocating piston engine proposed here.

BRIEF DESCRIPTION OF THE DRAWINGS

The invention is described in more detail below based on the drawing. They show.

DETAILED DESCRIPTION

Figure 1:
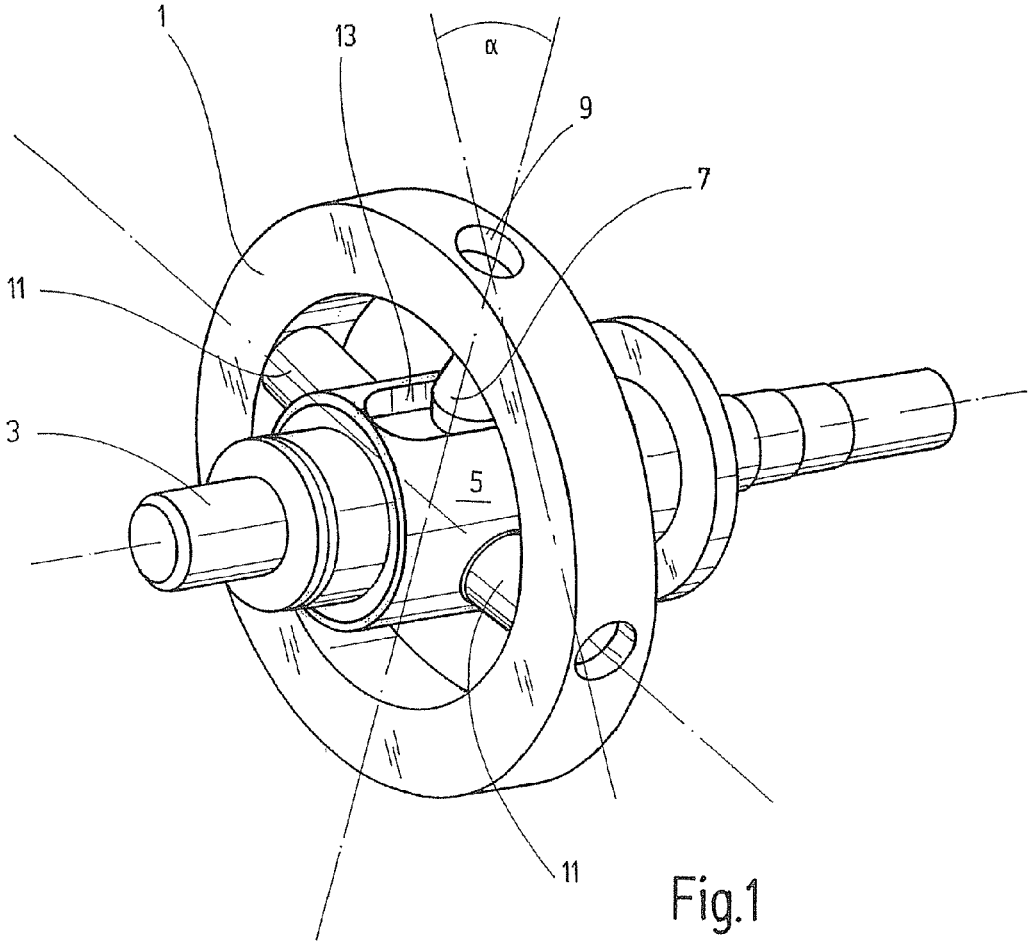
FIG. 1 A perspective view of an assembly of a reciprocating piston engine.

FIG. 1 shows an assembly of a reciprocating piston engine with a pivot element 1, a shaft 3 and a guide body 5 embodied here as a guide sleeve by way of example. The pivot element 1 is here embodied as a pivot ring, however, the embodiment as a pivot plate or swash plate is also conceivable.

The pivot element 1 is connected to the shaft 3 via a driving pin 7. The upper, that is, radially outer, end of the driving pin 7 catches in a recess 9 in the pivot ring 1, wherein the pivot element 1 is connected in a hinged manner to the driving pin 7 and can pivot around it.

The pivot element 1 is additionally connected to the guide body 5 via bearing sleeves 11 and pins (not discernible here) arranged therein.

The driving pin 7 attached to the shaft 3 engages through a longitudinal slot 13 of the guide body 5, so that it is rotated with a rotation of the shaft 3 together with the pivot element 1.

As already stated, the guide body 5 is supported on the shaft 3 in an axially displaceable manner. The maximum displacement of the guide body 5 on the shaft 3 is determined by the ends of the longitudinal slot 13 of the guide body 5, which interact with the driving pin 7 with a maximum displacement of the guide body 5. The guide body 5 is embodied here as a guide sleeve, however, other embodiments of the guide body are also conceivable in order to realize the functionality discernible from FIG. 1.

The shaft 3 is preferably connected without a coupling, preferably via a belt drive to the drive shaft of an internal combustion engine, for example, of a motor vehicle and is thus dependent at all times on the speed thereof.

The assembly shown in FIG. 1 is arranged in a drive chamber (not shown here) of a reciprocating piston engine.

The pivot angle $\alpha$ of the pivot element 1, that is, the angle about which the pivot element 1 is pivoted with respect to a plane on which the rotation axis of the shaft 3 stands upright, is influenced on the one hand via the compressive forces acting in the drive chamber as well as via inertia forces and spring forces. The decisive factor above all is thereby the relative pressure between the pressure on the drive chamber side of the at least one piston (not shown here) and the suction side pressure of the reciprocating piston engine prevailing on the opposite side of the piston.

The regulation of the pressure conditions between the pressure on the drive chamber side and the pressure on the suction side of the piston is preferably carried out via a control valve. The higher the pressure is adjusted on the drive chamber side relative to the pressure on the suction side of the piston, the smaller the stroke width of the piston and thus the pump performance of the reciprocating piston engine.

Based on the influences described above, during the rotation of the shaft 3, the pivot element 1 performs a pivot movement with a variable pivot angle $\alpha$ relative to the plane E, from which an axial movement of the at least one piston and the guide body 5 results. The mode of operation of a reciprocating piston engine is otherwise adequately known so that we do not need to go into further detail here.

Figure 2:
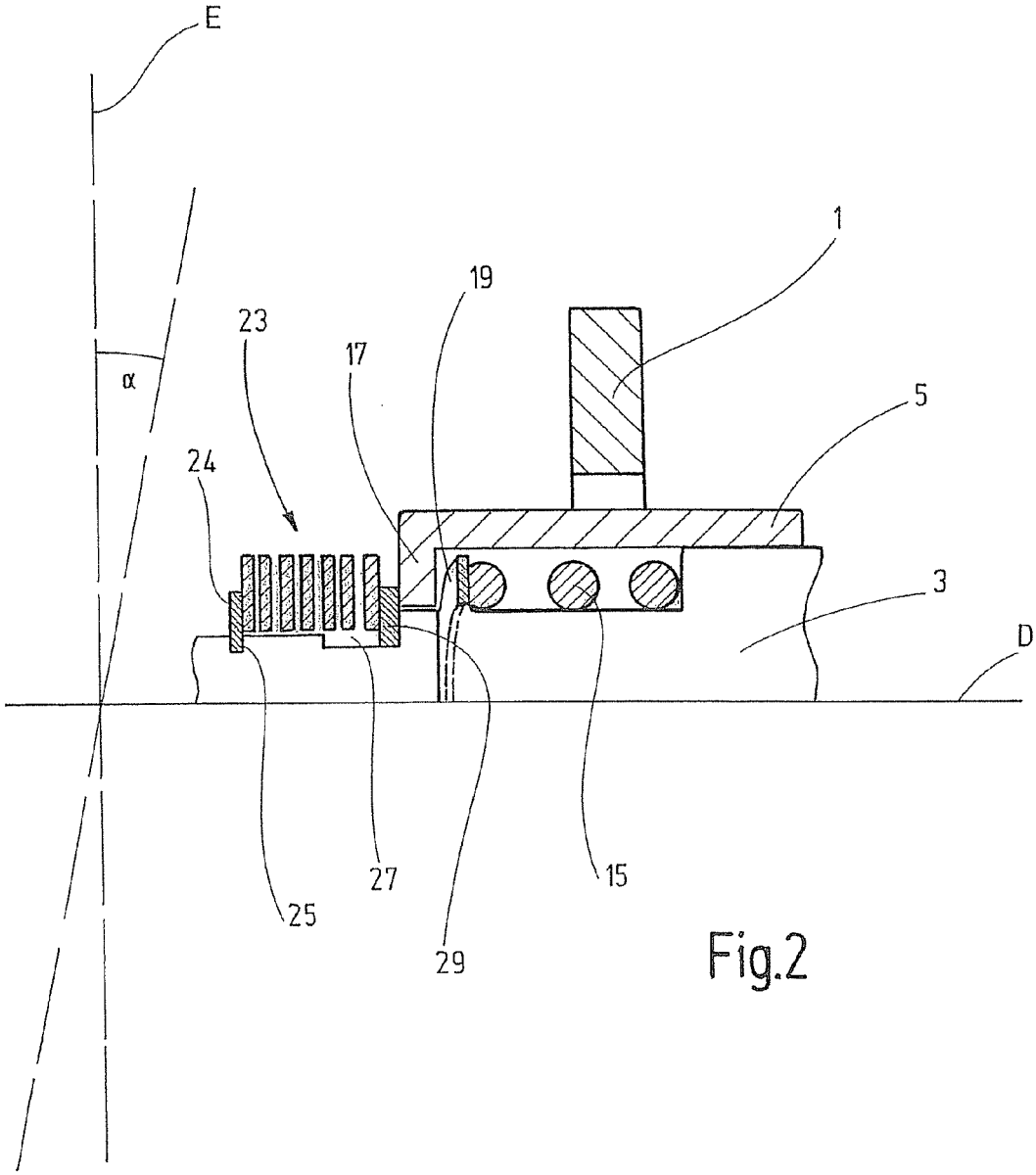
FIG. 2 A simplified sectional view of an assembly according to FIG. 1.

FIG. 2 shows a simplified sectional representation of the assembly shown in FIG. 1. Identical parts are provided with identical reference numbers, so that in this respect we refer you to the description for FIG. 1.

The pivot element 1 and the guide body 5, which are connected to one another via the bearing sleeves 11 (not shown here) and the pins arranged therein, are discernible in FIG. 2. The shaft 3 is also discernible, to which the pivot element 1 is coupled via the driving pin 7 (not shown here).

A return spring 15 is arranged between the inner surface of the guide body 5 and the circumferential surface of the shaft 3, which return spring here is embodied by way of example as a coil spring. A further spring element 19 is arranged between a wall section 17, running perpendicular to the rotation axis of the shaft 3, of the guide body 5 and the return spring 15. It is also conceivable to provide several spring elements 19 and to arrange them in series to the return spring 15. The spring element 19 preloads the return spring 15 in the starting position of the pivot element 1. It should be noted thereby that the spring element 19 is softer than the return spring 15, that therefore lower forces are necessary to compress the spring element 19 than is the case with the return spring 15.

Figure 3:
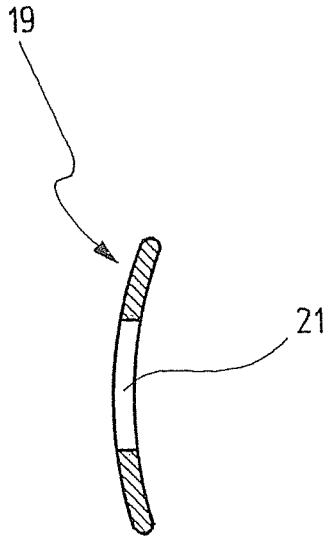
FIG. 3 A sectional view of a further spring element.
Figure 4:
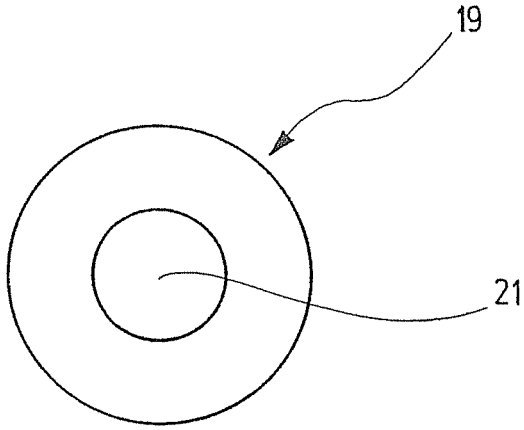
FIG. 4 A plan view of a further spring element according to FIG. 3.

As is clear in particular from FIGS. 3 and 4, the spring element 19 is embodied by way of example as a curved disk, which has an opening 21 for accommodating the shaft 3. The disk is thereby curved along a virtual diameter line in a quasi U-shaped manner. The spring element 19 therefore as it were grips around the shaft 3, wherein here by way of example the convex curvature of the spring element 19 to the wall section 17 of the guide body 5 and the concave curvature thereof to the return spring 15 is shown. The diameter of the opening 21 of the spring element 19 is preferably selected such that the spring element 19 can be displaced axially on the shaft 3.

A stop element 23 is also discernible from FIG. 2, which stop element on the one hand bears against a locking element 24, which is inserted into a groove 25 made in the shaft 3, and on the other hand against a retaining ring 29 that is supported in an axially moveable manner in a wide groove 27 made in the circumferential surface of the shaft 3. The stop element 23 is embodied here as a spring assembly purely by way of example, but it is also conceivable instead to provide at least one belleville spring or a rigid spring attached directly to the guide body.

FIG. 2 makes it clear that the stop element 23 is arranged outside the guide body 5. The stop element 23 is arranged such that it holds the guide body 5 in a position in which the pivot element 1 is located in its starting position, in which it therefore is pivoted at a starting pivot angle $\alpha_{Start}$ to the plane E. The retaining ring 29 arranged in the groove 27 thereby serves as a limit stop for the wall section 17 of the guide body 5.

If an adequate force is applied from the right to the stop element 23, or to the retaining ring 29, the stop element 23 embodied as a spring assembly and the retaining ring 29 are displaced in the groove 27 until the retaining ring 29 bears against the left end of the groove 27. In this position of the guide body 5 and thus of the pivot element 1, the pivot element 1 is located in its minimum stroke position in which it is pivoted at a minimum angle $\alpha_{Min}<\alpha_{Start}$ to the plane E.

In this minimum stroke position, the guide body 5 is displaced to the maximum to the far left.

In the minimum stroke position of the pivot element 1 it is not easily possible, for example, to start an RC which has previously run depending on the speed of the internal combustion engine. Therefore, as described above, the stop element 23 must be arranged and embodied such that it displaces the guide body 5 so far to the right along the shaft 3 that the pivot element 1 is pivoted at an angle $\alpha_{Start}>\alpha_{Min}$ to the plane E.

The stop element 23 therefore preferably has a higher spring rigidity than the return spring 15 and thus sets the starting position of the pivot element 1, or the starting pivot angle $\alpha_{Start}$ thereof relative to the plane E. The slight tilt of the pivot element 1 by the starting pivot angle $\alpha_{Start}$ in the clockwise direction is not discernible in FIG. 2 because of the dimensions.

If the internal combustion engine is now started and the RC is switched on, the pressure conditions in the drive chamber change through the use of a control valve such that the pivot element 1 performs a pivot motion at a pivot angle $\alpha>\alpha_{Start}$ relative to the plane E. The size of the pivot angle $\alpha$ is preset by the control valve, which regulates the pressure in the drive chamber. During the pivoting out of the pivot element 1, which otherwise leads to a higher piston stroke and thus to a higher flow rate of the reciprocating piston engine, a displacement of the guide body 5 takes place axially to the shaft 3. The guide body 5 is thus displaced the right in FIG. 2, while the pivot element 1 pivots out in a clockwise direction and thus has a larger pivot angle $\alpha$ than the starting pivot angle $\alpha_{Start}$ with respect to the plane E.

As already mentioned, the maximum displacement of the guide body 5 to the right is thereby limited by the dimensions of the longitudinal slot 13 shown in FIG. 1. The pivot element 1 can thus be pivoted up to a maximum pivot angle $\alpha_{max}$ with respect to the plane E, so that if a higher flow rate or a higher output of the air-conditioning system is desired, the pivot angle $\alpha$ of the pivot element 1 can pivot in a range from $\alpha_{Start}<\alpha<\alpha_{max}$.

If the compressive forces in the drive chamber now cause the pivot element 1, or the guide body 5, to be displaced from their starting positions, the spring element 19 and the return spring 15 are compressed by the displacement of the guide body 5. Initially, the force causes only a compression of the spring element 19, since it preferably has a lower spring rigidity than the return spring 15; the RC can thus start up without any difficulty.

The return spring 15, which is preloaded by the spring element 19, does not start to grip until a further displacement of the guide body 5, wherein the spring force of the return spring 15, against which the guide body 5 is displaced, preferably increases in a linear manner.

From a certain spring force, the additional spring element 19 is completely compressed, and the spring force of the return spring acts on the guide body 5 until it is deflected to the maximum, the left end of the longitudinal slot 13 therefore strikes against the driving pin 7. At this moment the pivot element 1 has reached its maximum pivot angle $\alpha_{max}$.

In the case of higher rotational speeds of the internal combustion engine, with constant pressure conditions in the drive chamber, the expelled flow rate of the reciprocating piston engine increases so that the pivot angle $\alpha$ has to be reduced if the cooling capacity is to be kept constant. This occurs through an interaction among other things of the pressure in the drive chamber of the RC, the resulting piston forces and the restoring moment of the pivot ring, so that the pivot angle $\alpha$ of the pivot element 1 is reduced and a displacement of the guide body 5 to the left occurs. The return spring 15 thereby presses with its spring force against the wall section 17 of the guide body 5, so that the guide body is ultimately displaced back into its starting position, wherein the pivot element 1 is aligned again at an angle $\alpha_{Start}$ to the plane E.

With even higher rotational speeds of the internal combustion engine and a very low cooling capacity requirement, the pivot angle $\alpha$ must be reduced even further to a pivot angle $\alpha_{Min}\leq\alpha_{Start}$, in order to guarantee a constant flow rate. The guide body 5 is thereby displaced to the left against the force of the stop element 23, whereby the retaining ring 29 is likewise displaced to the left against the spring force of the stop element in the groove 27. The guide body 5 is displaced to the left to the maximum when the retaining ring 29 strikes the left end of the groove 27. The pivot element 1 is then located in its minimum stroke position, where the pivot element 1 is therefore pivoted at an angle $\alpha_{Min}$ to the plane E, or lies therein. Due to manufacturing tolerances, the minimum pivot angle $\alpha_{Min}$ can thereby also have values less than zero, wherein no more stroke is given at a pivot angle $\alpha_{Min}=0$. Then a pressure cushion forms between the piston and the suction valve, which pressure cushion prevents the piston striking the suction valve.

Overall, compared to the return spring 15, the at least one further spring element 19 builds up a much lower spring force that must be overcome at the start of the machine, so that an easy, unhindered pivoting of the pivot element 1 is guaranteed. Shortly after the low spring force of the spring element 19 has been overcome, the spring force characteristic curve can thereby merge into the steeper preferably linear spring force characteristic curve of the return spring 15. The spring element 19 and the return spring 15 together thus produce a progressive spring characteristic curve during pivoting, starting from small pivot angles. The spring element 19 thus preferably has a lower spring rigidity than the return spring 15, so that a particularly soft transition between the starting position of the pivot element 1 at a starting pivot angle $\alpha_{Start}$ and higher pivot angles $\alpha$ is given.

The present invention therefore makes it possible to realize in an advantageous manner through a further spring element 19, which acts on the return spring 15 with a preload in a starting position of the pivot element 1, much improved start-up characteristics with much softer transitions of the individual spring forces, and to avoid undesirable vibrations.

LIST OF REFERENCE NUMBERS

1 Pivot element
3 Shaft
5 Guide body
7 Driving pin
9 Recess
11 Bearing sleeves
13 Longitudinal slot
15 Return spring
17 Wall section
19 Spring element
21 Opening
23 Stop element
24 Locking element
25 Groove
27 Groove
29 Retaining ring
E Plane
D Rotation axis

The invention claimed is:

1. A reciprocating piston assembly for motor vehicles comprising:

at least one piston supported in a moveable manner in a cylinder by a pivot element supported on a guide body attached to a shaft in an axially displaceable manner;

at least one return spring having a spring force acting on the pivot element in a direction of a starting position, in which the pivot element is pivoted at a starting pivot angle to a plane, on which a rotation axis of the shaft stands upright; and at least one further spring element acting on the return spring with a preload when the pivot element is located in the starting position, wherein the return spring and the at least one further spring element are arranged between the guide body and the shaft.

2. The reciprocating piston assembly according to claim 1, wherein the pivot element is a pivot ring.

3. The reciprocating piston assembly according to claim 1, wherein the at least one further spring element is a curved disk.

4. The reciprocating piston assembly according to claim 1, wherein the at least one further spring element has a lower spring rigidity than the at least one return spring.

5. The reciprocating piston assembly according to claim 1, wherein the at least one return spring is embodied as a coil spring.

6. The reciprocating piston assembly to claim 1, further comprising at least one stop element for setting the starting pivot angle of the pivot element.

7. The reciprocating piston assembly according to claim 6, wherein the at least one stop element is selected from a group including a spring assembly and at least one belleville spring.

8. The reciprocating piston assembly according to claim 7, wherein the at least one return spring has a lower spring rigidity than the at least one stop element.

9. The reciprocating piston assembly according to claim 1, wherein the at least one further spring element is arranged in series to the at least one return spring.

10. The reciprocating piston assembly according to claim 9, wherein the at least one further spring element and the at least one return spring cooperate to produce a progressive spring characteristic curve with an increasing pivot angle.

11. A reciprocating piston assembly for motor vehicles comprising:

at least one piston supported in a moveable manner in a cylinder by a pivot element supported on a guide body attached to a shaft in an axially displaceable manner;

at least one return spring having a spring force acting on the pivot element in a direction of a starting position, in which the pivot element is pivoted at a starting pivot angle to a plane, on which a rotation axis of the shaft stands upright; and at least one further spring element acting on the return spring with a preload when the pivot element is located in the starting position;

wherein the at least one further spring element is arranged in series to the return spring.

12. A reciprocating piston assembly for motor vehicles comprising:

at least one piston supported in a moveable manner in a cylinder by a pivot element supported on a guide body attached to a shaft in an axially displaceable manner;

at least one return spring having a spring force acting on the pivot element in a direction of a starting position, in which the pivot element is pivoted at a starting pivot angle to a plane, on which a rotation axis of the shaft stands upright; and at least one further spring element acting on the return spring with a preload when the pivot element is located in the starting position;

wherein the at least one further spring element and the return spring cooperate to produce a progressive spring characteristic curve with an increasing pivot angle.

* * * * *